United States Patent [19]

Carlson

[11] 4,344,615

[45] Aug. 17, 1982

[54] CONTROLLED FRICTION EXERCISING DEVICE

[76] Inventor: Charles H. Carlson, 52nd 11th St., Manhattan Beach, Calif. 90266

[21] Appl. No.: 138,887

[22] Filed: Apr. 10, 1980

[51] Int. Cl.[3] ..... A63B 23/00

[52] U.S. Cl. ..... 272/67; 272/131; 188/251 A

[58] Field of Search ..... 272/67, 131, 132, DIG. 3, 272/DIG. 4, 73; 188/77 R, 77 W, 83, 234, 250 B, 251 R, 251 A, 251 M, 75, 217

[56] References Cited

U.S. PATENT DOCUMENTS

| | | | |
|---|---|---|---|
| 1,887,942 | 11/1932 | Mueller | 272/132 |
| 2,252,868 | 8/1941 | Senn | 272/132 |
| 2,809,130 | 10/1957 | Rappaport | 188/251 A X |
| 2,855,200 | 10/1958 | Blickman | 272/131 |
| 2,960,280 | 11/1960 | Connelly et al. | 188/251 R X |
| 3,056,603 | 10/1962 | Levine et al. | 272/73 X |
| 3,184,234 | 5/1965 | Struble | 272/131 X |
| 3,227,447 | 1/1966 | Baker et al. | 272/73 X |
| 3,362,230 | 1/1968 | Dunn | 188/77 W X |
| 3,601,395 | 8/1971 | Morgan | 272/DIG. 3 |
| 3,622,153 | 11/1971 | Thompson | 272/DIG. 3 |
| 3,640,525 | 2/1972 | Proctor | 272/132 |
| 3,649,008 | 3/1972 | Zinken et al. | 272/67 |
| 3,653,659 | 4/1972 | Zinkin | 272/DIG. 3 |
| 3,995,853 | 12/1976 | Deluty | 272/132 |
| 4,060,241 | 11/1977 | Hegel | 272/DIG. 3 |
| 4,186,920 | 2/1980 | Fiore | 272/132 X |

*Primary Examiner*—Richard J. Apley

*Attorney, Agent, or Firm*—Jackson, Jones & Price

[57] ABSTRACT

An exercising device for strengthening and developing the hand, wrist, forearm and pectoral muscles. The device includes an elongated rotating pin having a central portion with a circular cross-section and gripping portions located on either side of and coaxial with the central portion. The central portion is received by a clamping mechanism which is held stationary by a mounting apparatus. The clamping mechanism includes an adjustment for varying the frictional force exerted by the clamp on the rotating member. Further included is a laminated liner disposed between the clamping mechanism and the rotating member comprised of a layer of rubber and a layer of self-lubricating plastic.

14 Claims, 4 Drawing Figures

CONTROLLED FRICTION EXERCISING DEVICE

BACKGROUND OF THE INVENTION

1. Field of the Invention

The present invention relates generally to exercising devices and more particularly to exercising devices for developing hand, wrist, forearm and pectoral muscles.

2. Prior Art

Although exercising devices exist for developing the muscles of the hand, wrist and forearm, such devices possess serious limitations. One such prior art device is comprised of a weight suspended on a line from a rotatably mounted shaft. The user grips the shaft with both hands then twists same so as to cause the weight to be lifted. The primary disadvantage of this device is that it is very bulky and cannot be easily moved from one location to another.

A portable exercising device for developing the hand and arm muscles is disclosed in U.S. Pat. No. 3,084,547. This device includes two coaxially mounted tubular members coupled together by a torsion bar made of nylon. The user exercises by gripping the device with one tubular member in each hand and twisting the members in opposite directions. A similar device is disclosed in U.S. Pat. No. 3,132,861 except the nylon torsion bar is replaced by a spring element. Although both of these devices are compact and easily transported, the rotational resistance is created by rotating the gripping members in opposite directions. The antagonist muscle group in one limb therefore opposes the agonist group in the other limb with the maximum force exerted being determined by the weakest muscle group. Thus, the strongest muscles are not adequately exercised using the devices disclosed in U.S. Pat. Nos. 3,084,547 and 3,132,861.

The subject invention overcomes the limitations of the above-described prior art devices. As will become apparent, the subject device is compact and may be easily transported. Morever, the device permits efficient and thorough exercise of all the relevant muscle groups inasmuch as the opposing force may be manually varied and is independent of the strength of any particular muscle group. In addition, the subject invention is sturdy and durable in construction and is inexpensive to manufacture.

SUMMARY OF THE INVENTION

An exercising device for strengthening and developing the hand, wrist, forearm and pectoral muscles is disclosed. The device includes an elongated rotating member having a central portion with a generally circular cross-section. The rotating member further includes gripping portions located on either side of the central portion. An apparatus, such as a clamping mechanism, is provided for applying a frictional force to the central portion of the elongated member. Such apparatus further includes an adjustment for varying the magnitude of the frictional force. A mounting mechanism is provided which prevents the frictional force applying apparatus from rotating.

In operation, the user faces the device and grasps each of the two gripping portions. The user then rotates the rotating member, one hand at a time, with rotational resistance being determined by the frictional force adjustment.

DETAILED DESCRIPTION OF THE INVENTION

Figure 1:
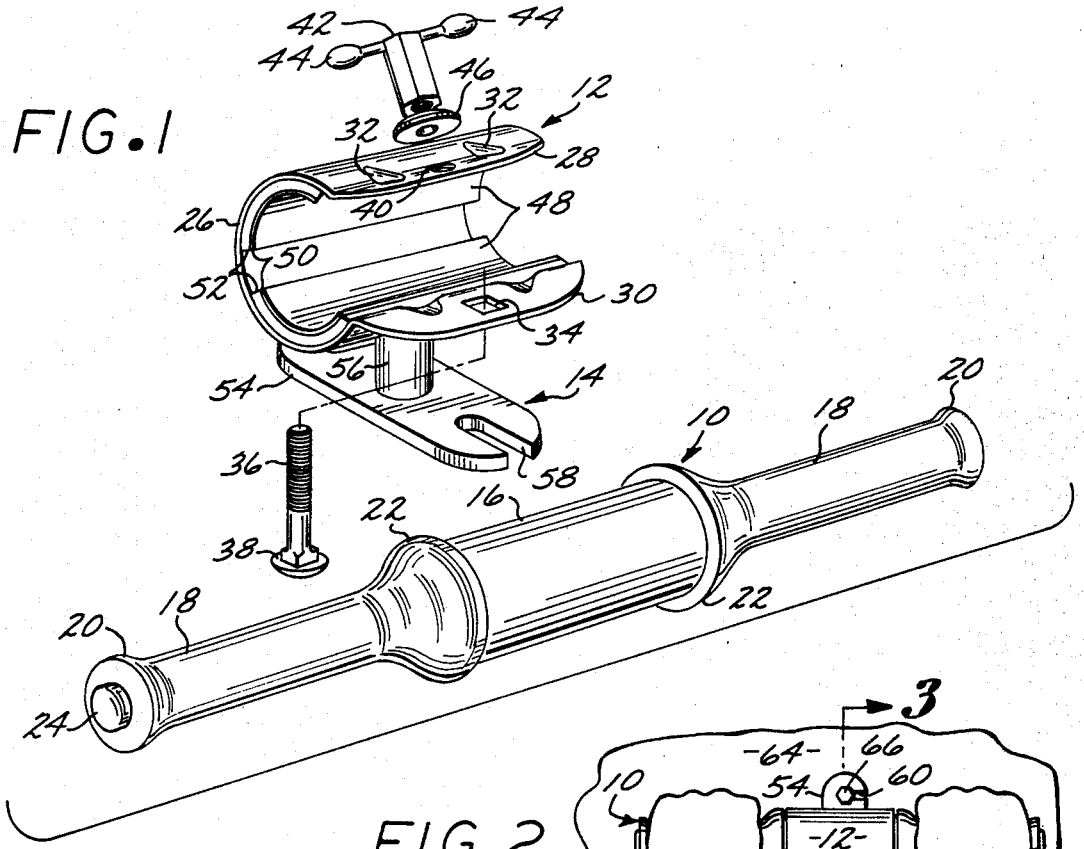
FIG. 1 is an exploded view of the subject exercising device.

Referring now to the drawings, the details of the subject exercising device will now be described. As best can be seen in FIG. 1, the subject invention is comprised of an elongated wooden pin member, generally designated by the numeral 10, a clamp member, generally designated by the numeral 12, and a base member, generally designated by the numeral 14.

Pin member 10 is preferably made of wood although other materials such as plastic may be used. Mahogany has been found to be particularly suitable for this purpose because of its durability and attractiveness. Pin member 10, which is preferably turned on a lathe, includes a center section 16 and gripping sections 18 located at either side of the center section and coaxial therewith. Raised sections 20 are located at the extreme ends of the pin member to prevent the user's hands from slipping. Raised sections 22 are formed adjacent each end of the center section 16 for the purpose of retaining the pin member within the clamp member 12. A silicon lubricant is preferably applied to the surface of center section 16. A wax-like silicon lubricant sold by Dow Corning under the trademark Molykote 557 has been found to be suitable for this purpose. Other dry lubricants similar to Molykote 557 brand lubricant can also be used.

Figure 2:
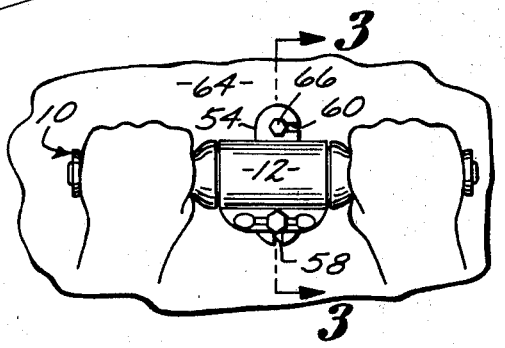
FIG. 2 is a top plan view of the subject exercising device showing the manner in which such device is used.
Figure 3:
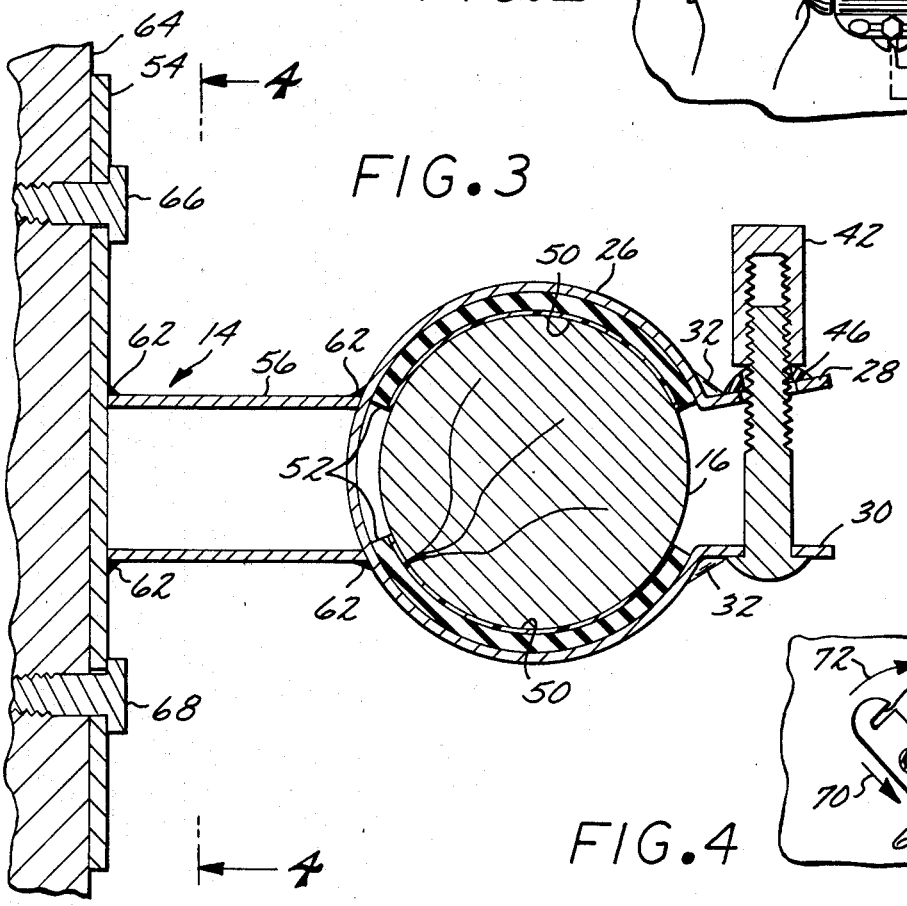
FIG. 3 is a cross-section side view of the subject exercising device taken substantially through section line 3—3 of FIG. 2.

Pin member 10 is typically approximately fourteen inches in length with the two gripping sections being approximately five inches in width each and the central section being approximately four inches in width. The diameter of each of the gripping sections is typically approximately one and one half inches with the diameter of the central section being approximately two inches. Decorative metal buttons 24 can be fastened at both ends of pen member 10 to cover the lathe holes formed therein. As can best be seen in FIGS. 2 and 3, pin member 10 is held by clamp member 12. Clamp member 12 is comprised of a clamping section 26 having a generally C-shaped cross-section (FIG. 3). The width of clamping section 26 is slightly less than that of center section 16 of the pin member so that the clamping section can be received between raised sections 22. In addition, the cross-sectional diameter of clamping section 26 corresponds generally to the diameter of center section 16. Clamp member 12, which is preferably fabricated from a mild steel, is further provided with upper and lower flanges 28 and 30 which extend outwardly from the upper and lower ends, respectively, of clamping section 26 and are generally at right angles thereto. Fillets or raised sections 32 are formed at the juncture of the clamping section 26 and flanges 28 and 30 to provide rigidity.

Lower flange 30 is provided with an opening 34 formed in the central region thereof for receiving a carriage bolt 36. Opening 34 is square to accomodate the square cross-section portion 38 of bolt 36 so as to lock the bolt in place. Upper flange 28 is also provided with a centrally disposed opening 40 for receiving bolt 36. Bolt 36 is secured in place by a wing nut 42 having relatively large wings 44 so that the nut may be easily tightened and loosened. In addition, the body of wing nut 42 is relatively long so that clamping section 26 does not interfere with wings 44 when the wing nut is turned. A washer 46 made of a self-lubricating plastic such as nylon is positioned between upper flange 28 and wing nut 42. Washer 46 is preferably of substantial thickness and is provided with a rounded upper section to accomodate the varying angle between wing nut 42 and upper flange 28 when the nut is tightened and loosened.

The interior surface of clamping section 26 is provided with two liner sections 48 which engage the lubricated central portion 16 of the pin member 10. Each liner section 48 is comprised of an outer layer 50 of self-lubricating plastic and an inner resilient layer 52 disposed between the outer layer and the inner surface of clamping section 26. Teflon brand material and Neopreme brand rubber have been found suitable for the outer layer 50 and inner layer 52, respectively. Other materials having a relatively low coefficient of friction such as Teflon brand material can also be used. The Neopreme layer 52 is preferably approximately one quarter inch thick and the Teflon layer 50 is approximately one thirty-second of an inch thick. Inner and outer layers 52 and 50 are laminated together using a suitable adhesive such as rubber contact cement. To ensure adequate bonding, the inner surface of Teflon layer 50 should be roughened by chemical etching. Contact cement can also be used to bond the two laminated liner sections 48 to the inner surface of clamping section 26.

Base member 14, which supports clamp member 12, is comprised of an elongated base 54 and a cylindrical column 56 disposed between the base and clamp member. Base 54 is aligned transverse to pen member 10 and is approximately six inches in length whereas column 56 is approximately one and one half inches in length. A mounting notch 58 is preferably formed in one end of base 54 and is in alignment with the major axis thereof. A second mounting notch 60 is formed in the other end of base 54 and is generally transverse with the major axis of the base.

Base 54 and column 50 of the base member 14 are preferably fabricated from the same material as is clamp member 12, namely, mild steel. In order to enhance the appearance of the subject exercising device, base member 14 and clamp member 12 are chrome plated. Prior to plating, the disassembled components are polished. Next, column 56 is secured to clamp member 12 and base 54 by welding. In order to obviate the necessity of repolishing, it is preferable that induction welding be used inasmuch as induction welding produces smooth, uniform welds 62 and causes very little carbonization.

Having described in detail the structure of the subject exercising device, the operation of the device will now be disclosed. First, the wooden pin member 10 is positioned within the clamp member 12 as shown in FIGS. 2 and 3. Next, bolt 36 is inserted through openings 34 and 40 with washer 46 in place. Bolt 36 is then secured by wing nut 42. Wing nut 42 is tightened, as will be subsequently described.

The rotational resistance of pin member 10 may be continuously varied by tightening or loosening wing nut 42. The self-lubricating liner sections 48, in combination with the lubricant applied to center section 16, ensure that the rotational resistance of pin 10 caused by the frictional force between center section 16 and liners 48 remains relatively constant for a given wing nut setting. Resilient layers 52 of liners 48 encourage the liners to grip center section 16 of pin 10 with a uniform force about the circumference of the pin. Furthermore, it has been found that it is preferable that the liner 48 be divided into two or more smaller sections rather than a larger single section in order to facilitate assembly. In addition, the rotational resistance can be more easily controlled with greater resolution if more than one liner section is used.

Figure 4:
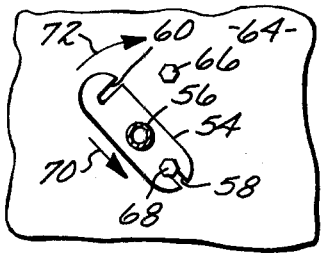
FIG. 4 is a cross-section plan view taken substantially through section line 4—4 of FIG. 3 and illustrates the manner in which the subject exercising device is secured and removed from a wall.

The exercising device may be fastened to a vertical wall 64 using mounting notches 58 and 60 or simply placed on a horizontal surface of a table or the like with the bottom of base 54 resting on the surface. If a wall mount is to be used, lag bolts 66 and 68 are first screwed into the wall 64 in vertical alignment and are spaced apart a distance which corresponds to the vertical distance between notches 58 and 60. The lag bolts are only partially driven into the wall, with the bolt heads positioned away from the wall a distance slightly greater than the thickness of base 54. As can best be seen in FIG. 4, base 54 is then placed flush against wall 64 and is forced in the direction of arrow 70 until lag bolt 68 is positioned in lower mounting notch 58. Base 54 is then rotated to a vertical position in the direction of arrow 72 so that upper mounting notch 60 receives lag bolt 66. The base 54 is held in the desired vertical position by friction. Removal is accomplished by reversing the above steps.

Once the subject excercising device is in position, the operator faces the device with his/her left and right hands grasping the left and right gripping sections 18, respectively. The operator may be either standing or sitting. The operator then rotates the pin member 10, one hand at a time, away from himself/herself as far as possible. When the right hand is turning, the left hand grip is released and, conversely, when the left hand is turning, the right hand grip is released. Other muscle groups are exercised by reversing the direction of rotation.

The rotational resistance of the device is adjusted by rotating wing nut 42. Athletes should initially adjust the rotational resistance so that the subject can, with some difficulty, complete one set (a set comprises fifty hand rotations in each direction). As the subject's strength increases, the rotational resistance should be increased accordingly.

Thus, a novel exercising device has been disclosed. Although a prefered embodiment of the subject invention has been described in detail, many variations which fall within the spirit and scope of the subject invention, as defined by the appended claims, would be obvious to those skilled in the art.

What is claimed is:

1. An exercise device comprising:

an elongated rotatable member having a central portion with a generally circular cross-section and a gripping portion located on either side of said central portion;

a clamping mechanism which encircles a substantial part of said central portion;

mounting means for preventing rotation of said clamping mechanism when said elongated member is rotated;

a liner disposed between said clamping mechanism and said central portion of said elongated member, said liner including a layer of resilient material adjacent said clamping mechanism and a layer of material having a relatively low coefficient of friction adjacent said central position; and adjustment means for tightening and loosening said clamping mechanism;

whereby an operator can exercise by grasping said gripping portions and rotating said elongated member with the resistance of rotation being adjustable by way of said adjustment means.

2. The exercising device of claim 1 wherein said elongated member is made of wood.

3. The exercising device of claim 1 wherein said resilient layer is made of rubber.

4. The exercising device of claim 1 wherein said layer of material is plastic.

5. The exercising device of claim 1 wherein said liner is divided into at least two separated sections.

6. The exercising device of claim 1 wherein said mounting means comprises of an elongated base having a major axis generally transverse to the major axis of said elongated member and a connecting member between said base and said clamp.

7. The exercising device of claim 1 wherein said layer of material is self-lubricating plastic.

8. The exercising device of claim 1 wherein said elongated member is wood, said layer of material is plastic and wherein a dry lubricant is disposed between said central portion of said elongated member and said plastic layer.

9. The exercising device of claim 1 wherein said elongated member is made of mahogany wood.

10. The exercising device of claim 1 wherein said clamping mechanism has a generally C-shaped cross-section.

11. The exercising device of claim 1 wherein said layer of material is plastic, said clamping mechanism has a generally C-shaped cross-section and said elongated mechanism is wood.

12. The exercising device of claim 11 wherein said elongated member is wood and a dry lubricant is disposed between said plastic layer and said central portion of said elongated member.

13. An exercise device comprising:

an elongated rotatable member having a central portion with a generally circular cross-section and a gripping portion located on either of said central portion;

a clamping mechanism having a generally C-shaped cross-section which encircles a substantial part of said central portion;

mounting means for preventing rotation of said clamping mechanism when said elongated member is rotated, said mounting means including an elongated base having a major axis generally transverse to the major axis of said elongated member and a connecting member between said base and clamping mechanism;

a liner disposed between said clamping mechanism and said central portion of said elongated member, said liner including a layer of resilient material adjacent said clamping mechanism and a layer of self-lubricating plastic adjacent said central portion, with said liner being divided into at least two separated sections; and adjustment means for tightening and loosening said clamping mechanism;

whereby an operator can exercise by grasping said gripping portion and rotating said elongated member with the resistance of rotation being adjustable by way of said adjustment means.

14. The exercise device of claim 13 wherein said elongated member is made of wood and said resilient layer is rubber.

* * * * *